US007988650B2

(12) United States Patent
Nan

(10) Patent No.: US 7,988,650 B2
(45) Date of Patent: Aug. 2, 2011

(54) MASSAGE DEVICE WITH SPIRAL WAVE FORM ACTION

(75) Inventor: Simon Siu Man Nan, Ontario (CA)

(73) Assignee: Nanma Manufacturing Co., Ltd. (HK)

( * ) Notice: Subject to any disclaimer, the term of this patent is extended or adjusted under 35 U.S.C. 154(b) by 853 days.

(21) Appl. No.: 12/024,788

(22) Filed: Feb. 1, 2008

(65) Prior Publication Data

US 2009/0198158 A1 Aug. 6, 2009

(51) Int. Cl.
*A61H 19/00* (2006.01)
*A61H 21/00* (2006.01)
*A61H 15/00* (2006.01)

(52) U.S. Cl. ..... 601/87; 601/112; 601/119

(58) Field of Classification Search ..... 601/19, 601/20, 63, 85, 87, 112, 118, 119, 120, 122, 601/123, 125, 126; 600/38
See application file for complete search history.

(56) References Cited

U.S. PATENT DOCUMENTS 1,449,233 A * 3/1923 Kuhn ..... 601/118
1,630,149 A * 5/1927 Wahrt ..... 601/119
6,190,307 B1 * 2/2001 Tsai ..... 600/38
6,860,861 B2 3/2005 Polychronis
7,081,087 B2 7/2006 Jannuzzi
7,104,950 B2 9/2006 Levy
7,559,886 B2 * 7/2009 Knyrim ..... 600/38
7,803,126 B2 * 9/2010 Nan ..... 601/72
7,828,717 B2 * 11/2010 Lee ..... 600/38
2005/0234292 A1 10/2005 Faulkner et al.
2006/0264700 A1 11/2006 Guy
2008/0207990 A1 * 8/2008 Nan ..... 600/38

FOREIGN PATENT DOCUMENTS

DE 202007012531 U1 * 1/2008
EP 1720503 A1 * 11/2006
EP 2191804 A1 * 6/2010
WO 99/59516 A1 11/1999

* cited by examiner

*Primary Examiner* — Danton DeMille
(74) *Attorney, Agent, or Firm* — Polsinelli Shughart PC

(57) ABSTRACT

A massage device includes a handle engaged to a driving unit having a rotatable output shaft for driving an actuation unit which produces a spiral wave form action in a longitudinal direction is disclosed. The actuation unit includes an arrangement of bearing plates engaged to one another and mounted on the rotatable output shaft. Each of the bearing plates is engaged to a respective rotary ring in a manner that permits a rotating action by the bearing plates while the rotary rings have a slipping action relative to the output shaft in order to produce the spiral wave form action by the massage device.

22 Claims, 4 Drawing Sheets

MASSAGE DEVICE WITH SPIRAL WAVE FORM ACTION

FIELD

This document relates to a massage device, and more particularly to an electrically powered massage device having a massage actuator with a spiral wave form action.

SUMMARY

In an embodiment, a massage device may include a driving unit operatively engaged to a rotatable output shaft having a distal end portion with a handle having a power source in operative association with the driving unit. The handle may have a control panel for controlling the operation of said driving unit and an actuation unit operatively engaged to the output shaft of the driving unit. In addition, the actuation unit includes an arrangement of bearing plates engaged to one another and mounted along the output shaft with each bearing plate being engaged to a rotary ring, wherein each rotary ring defines a center hole and a plurality of segments circumferentially defined about the center of the rotary ring. Each of the bearing plates defines a plurality of holes and pegs circumferentially spaced about an eccentric through-hole, wherein each rotary ring is adapted to be engaged within the center hole of one of the bearing plates such that the arrangement of bearing plates will rotate upon rotation of the output shaft while each rotary ring will have a slipping action relative to the output shaft in order to produce a spiral wave form action by the actuation unit.

In another embodiment, a massage device for providing a spiral wave form action may include a driving unit operatively engaged to a rotatable output shaft having a distal end portion. A handle may have a power source in operative association with the driving unit with the handle having a control panel for controlling the operation of the driving unit. An actuation unit may be operatively engaged to the output shaft of the driving unit with the actuation unit having an arrangement of bearing plates mounted to the output shaft. Each of the bearing plates may be engaged to a rotary ring with an anti-friction material being interposed between the bearing plates and a respective rotary ring, wherein actuation of the output shaft causes the plurality of bearing plates to have a rotating action and the respective rotary ring to have a slipping action relative to the output shaft in a manner that causes the actuation unit to have a spiral wave form action.

In yet another embodiment, a massage actuator may include a driving unit operatively engaged to a rotatable output shaft having a distal end portion and a handle having a power source in operative association with the driving unit with the handle having a control panel for controlling the operation of the driving unit. In addition, an actuation unit may be operatively engaged to the output shaft of the driving unit having an arrangement of bearing plates mounted to the output shaft. Each of the bearing plates may be engaged to a rotary ring with an anti-friction material being interposed between the bearing plates and a respective rotary ring, wherein actuation of the output shaft causes the plurality of bearing plates to have a rotating action and the respective rotary ring to have a slipping action relative to the output shaft in a manner that causes the actuation unit to have a spiral wave form action.

Implementation of the above embodiments may include one or more of the following features:

The bearing plates are engaged to one another by engaging the plurality of pegs of one of the bearing plates to the plurality of holes of another one of the bearing plates.

The plurality of segments on each rotary ring prevents the rotating action of the rotary rings relative to the bearing plates.

The massage device further includes a resilient outermost sleeve defining a hollow chamber with the massage actuator being adapted to be disposed within the hollow chamber of the outermost sleeve such that a spiral wave form action is imparted to the outermost sleeve by the massage actuator.

The operation of the driving unit causes the outermost sleeve to move in the spiral wave form action as the bearing plates are made to rotate and the rotary rings are prevented from having a rotating action relative to the output shaft.

Mounting the bearing plates to the output shaft requires the output shaft to be inserted through the eccentric through-hole of each of the bearing plates.

The eccentric through-hole defines a pair of slots and the output shaft defines a pair of opposing protrusions, wherein the opposing protrusions are adapted to engage the opposing slots when mounting one of the bearing plates to the output shaft.

The arrangement of bearing plates mounted to the output shaft has a generally sinusoidal configuration.

At least one protrusion is engaged to one of the bearing plates mounted to the output shaft.

The massage device further includes a control panel having one or more actuators for controlling the operation of the massage actuator.

One of the one or more actuators controls the spiral wave form action of the massage actuator.

The output shaft defines a pair of opposing protrusions and the eccentric through-hole defines a pair of slots adapted to engage the pair of opposing protrusions.

A gap is defined when one of the bearing plates is engaged to a respective one of the rotary rings with an anti-friction material being disposed in the gap.

The massage device further includes a hollow resilient outermost sleeve adapted to engage the massage actuator such that the outermost sleeve has a spiral wave form action imparted by the actuator generation unit during operation of the massage actuator.

The anti-friction material may be a lubricant or a material having a low friction coefficient.

The power source is one or more batteries.

The massage device further includes a control panel having a plurality of actuators for controlling the various operations of the massage device.

The eccentric through-hole is defined off-center relative to the bearing plate.

Additional objectives, advantages and novel features will be set forth in the description which follows or will become apparent to those skilled in the art upon examination of the drawings and detailed description which follows

BRIEF DESCRIPTION OF THE DRAWINGS

Corresponding reference characters indicate corresponding elements among the view of the drawings. The headings used in the figures should not be interpreted to limit the scope of the claims.

DETAILED DESCRIPTION

Figure 1:
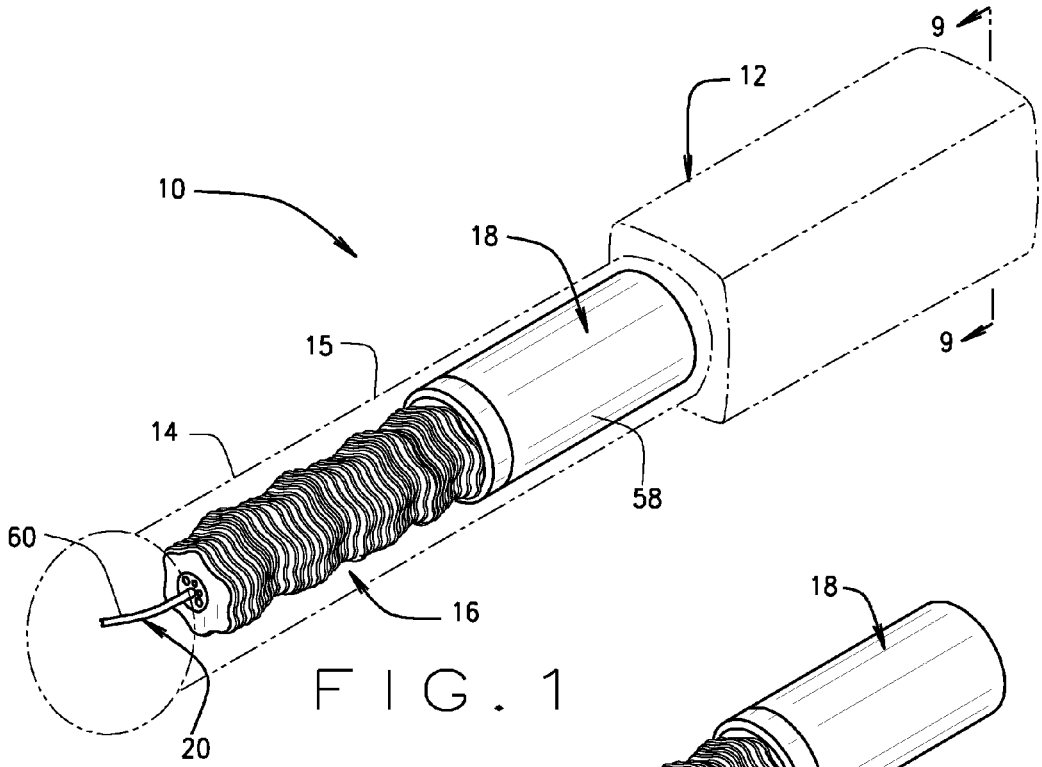
FIG. 1 is a perspective view of the massage device showing the massage actuator that provides the spiral wave form action with the outmost sleeve and the handle shown in phantom.

Referring to the drawings, an embodiment of the massage device having a spiral wave form action is illustrated and generally indicated as 10 in FIG. 1. As shown, the massage device 10 may include a handle 12 (shown in phantom) operatively engaged to a flexible elongated massage actuator 14 that includes a hollow outermost sleeve 15 made from a resilient material encasing an actuation unit 16 for providing a spiral wave form action as shall be discussed in greater detail below.

Figure 2:
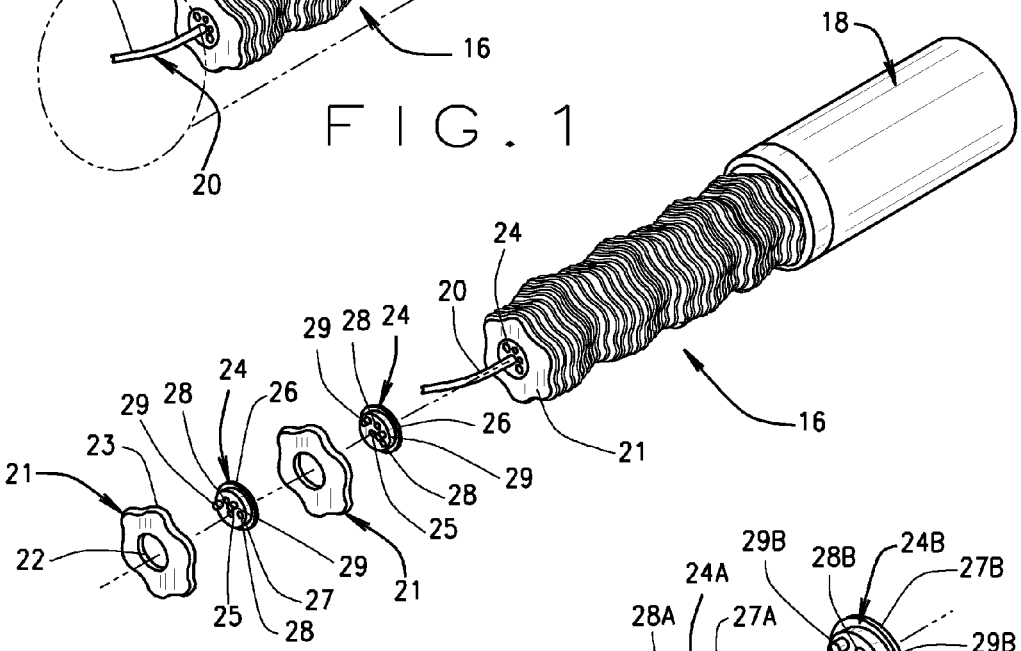
FIG. 2 is an exploded view of the massage device illustrating the components of the massage actuator.
Figure 2A:
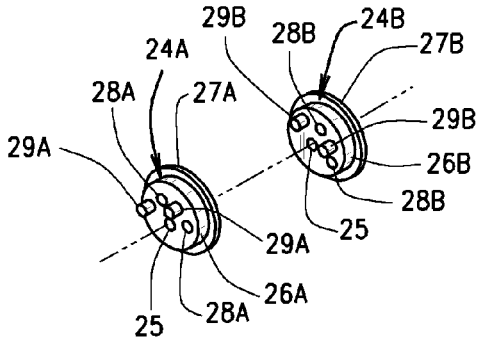
FIG. 2A is an enlarged view of the bearing plates of the actuation unit of the massage actuator.

Referring to FIGS. 1, 2 and 2A, the massage device 10 further includes a driving unit 18 that is operatively engaged to the actuation unit 16 and is powered by a battery source (not shown) encased inside the handle 12. In one embodiment, the power source may be one or more batteries, but the massage device 10 may also be plugged into a conventional wall socket to obtain power through a power cord operatively engaged to the driving unit 18. The handle 12 includes a control panel 48 (FIG. 9) having a plurality of actuators 50, such as a switch, dial, lever or button, operatively associated with the driving unit 18 for activating and controlling the operation of the massage device 10. As shown, the actuators 50 are located on the end of the handle 12; however, other embodiments may have the actuators 50 located along other portions of the handle 12.

Figure 9:
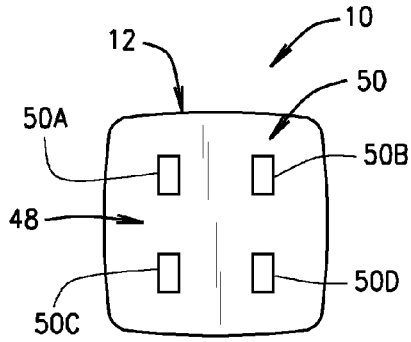
FIG. 9 is a rear view of the massage device shown in FIG. 1 illustrating the control panel and actuators.

Referring to FIG. 9, one of the actuators 50A may be an ON/OFF switch that activates the spiral wave form action of the actuation unit 16, while another actuator 50B may be an ON/OFF switch that activates a vibratory component (not shown) of the massage device 10 that provides a vibrating function. The massage device 10 may also include an actuator 50C that allows for different vibratory actions by the vibratory component when sequentially activated by the user. For example, the vibratory component may be activated to have different levels of vibratory action or the vibrations may be pulsed at different predetermined sequences. Finally, an actuator 50D may be included that adjusts the speed of the actuation unit 16 once actuator 50A is activated. It is contemplated that any number of actuators 50 may be utilized to control a respective number of functionalities of the massage device 10.

Figure 3:
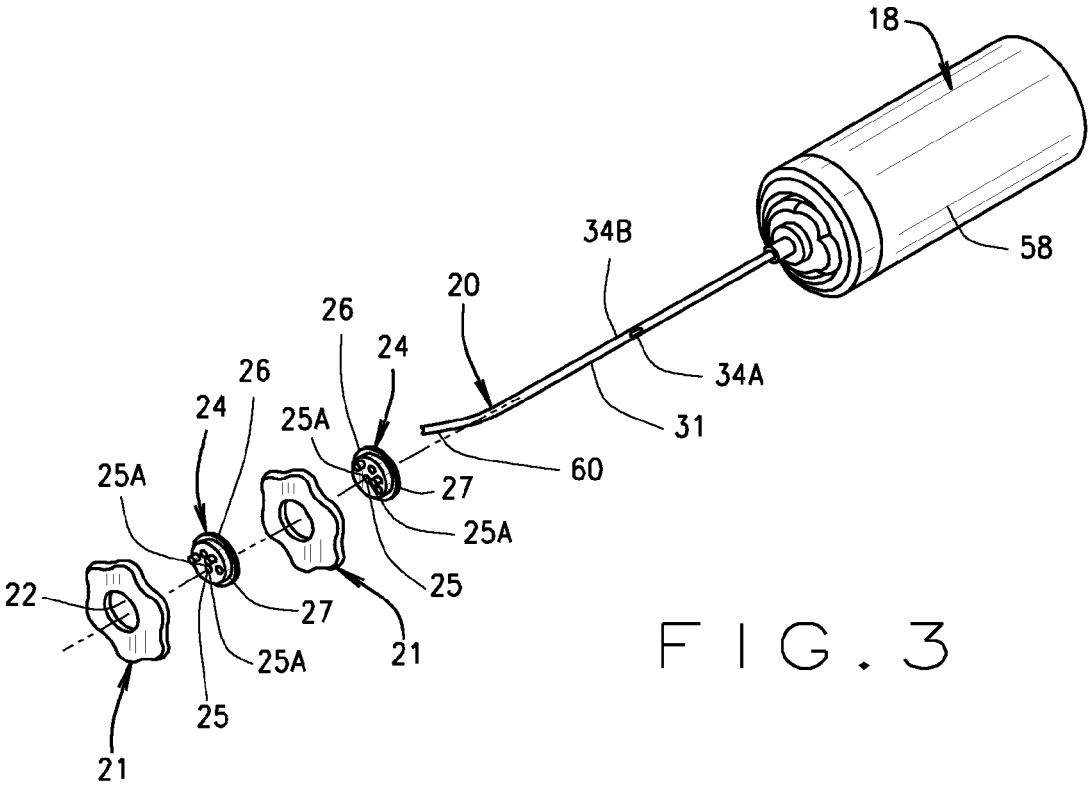
FIG. 3 is another exploded view of the massage device illustrating the components of the actuation unit removed from the output shaft of the driving unit.

The driving unit 18 includes a gearbox (not shown) encased inside a housing 58 that is operatively engaged to a rotatable output shaft 20 extending axially from the driving unit 18. Referring to FIG. 3, the output shaft 20 includes an elongated body 31 that defines a curved distal portion 60 and a pair of opposing knob-like protrusions 34A and 34B. As shown, the output shaft 20 is adapted to engage a plurality of bearing plates 24 with a respective bearing plate 24 being adapted to engage one of a plurality of rotary rings 21 to form the actuation unit 16 that provides the spiral wave form action imparted to the outermost sleeve 15.

Referring to FIGS. 2A, 6A, 7A and 7C, each of the plurality of bearing plates 24 defines an eccentric through-hole 25 adapted to engage the output shaft 20. Each eccentric through-hole 25 defines a pair of slots 25*a* on the internal surface along the axis of the bearing plate 24. The slots 25*a* of each eccentric through-hole 25 may provide respective clearances to the protrusions 34A and 34B on the output shaft 20 when the bearing plate 24 is passed over the protrusions 34A and 34B when assembling the actuation unit 16. After assembly, slots 25*a* of one of the bearing plates 24 will be engaged with the knob like protrusions 34A and 34B on the output shaft 20 such that there is no relative angular rotation between the output shaft 20 and the respective bearing plate 24. In this arrangement, torque can be imparted from the output shaft 20 to all the bearing plates 24 assembled thereon.

Further, each bearing plate 24 also defines a pair of holes 28 and a pair of pegs 29 concentrically spaced about the center of the eccentric through-hole 25. In one embodiment, the holes 28 and pegs 29 are circumferentially and alternatively spaced about the center of the eccentric through-hole 25 at equal angular positions. The bearing plate 24 also includes a circular rim 27 defined around an outer circumferential surface portion 26. After the actuation unit 16 is assembled with a respective bearing plate 24 engaged to a respective rotary ring 21, the circular rim 27 provides an axial restriction on the rotary ring 21 to prevent the rotary ring 21 from moving along the axis of the output shaft 20 after the bearing plates 24 and rotary rings 21 are assembled upon the output shaft 20.

As shown in FIGS. 3, 4 and 6A-6C, rotary ring 21 defines a center hole 22 in communication with a coaxial step portion 36 with a plurality of segments 23 defined along the outer circumference of the rotary ring 21. The coaxial step portion 36 defines an inner shoulder adapted to seat the rotary ring 21 to the bearing plate 24 during engagement. Referring to FIG. 2A, an example of how one bearing plate 24 is engaged to another bearing plate 24 for assembling the actuation unit 16 will be discussed. During assembly of the actuation unit 16, a bearing plate 24B with a configuration identical to that of bearing plate 24A is engaged to a rotary ring 21 and then mounted to the output shaft 20. Bearing plate 24A is also engaged to a rotary ring 21, mounted to the output shaft 20, and then engaged to the bearing plate 24B by engaging the pegs 29 of bearing plate 24B with respective holes 28 of the bearing plate 24A.

This sequence is repeated for every bearing plate 24 until a sufficient number of bearing plates 24 have been mounted to the output shaft 20. The engagement of pegs 29 of the bearing plate 24A to holes 28 of the adjacent bearing plate 24B causes the bearing plate 24A to have a relative angular position about the center of eccentric through-hole 25, thereby preventing the bearing plates 24 from rotating relative to the output shaft 20 after the bearing plates 24 are assembled thereon as shall be discussed in greater detail below.

Figure 4:
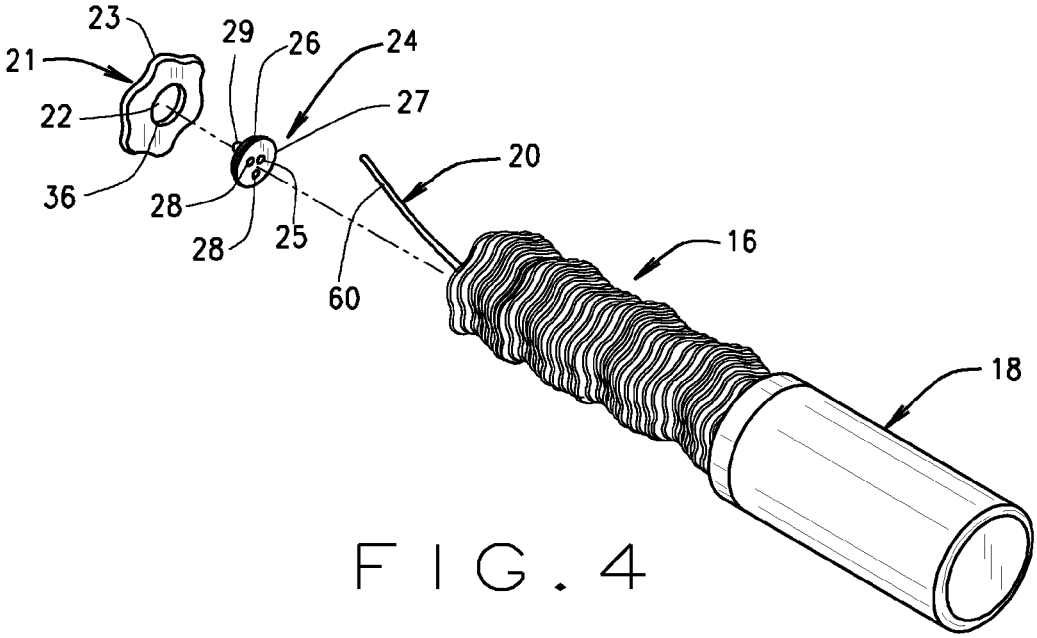
FIG. 4 is yet another exploded view of the massage device illustrating certain components of the actuation unit.
Figure 5:
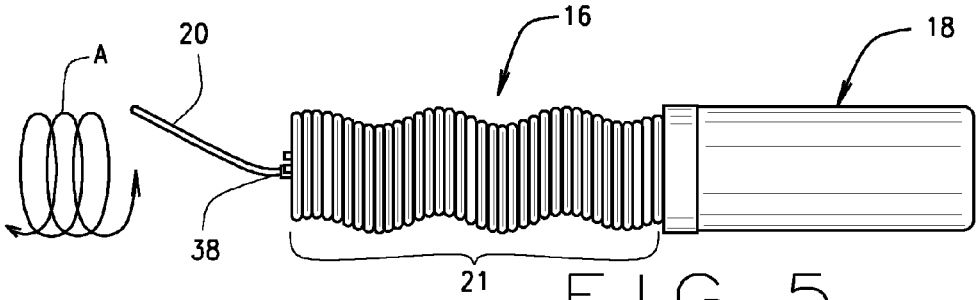
FIG. 5 is a side view of the massage device.
Figure 6A:
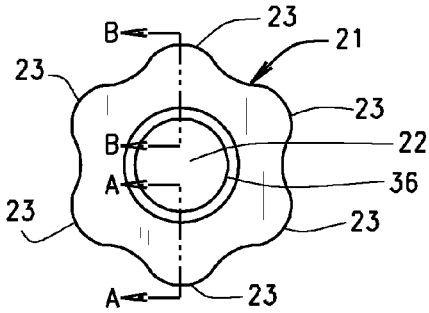
FIG. 6A is a front view of the rotary ring used in the actuation unit of the massage actuator.
Figure 6C:
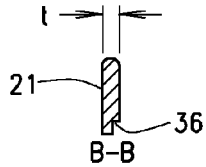
FIG. 6C is a cross-sectional view of the rotary ring taken along line B-B of FIG. 6A.
Figure 6B:
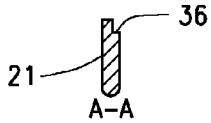
FIG. 6B is a cross-sectional view of the rotary ring taken along line A-A of FIG. 6A.

As noted above, prior to assembling the bearing plates 24 to the output shaft 20, each of the bearing plates 24 are engaged to a respective rotary ring 21. Once a rotary ring 21 is engaged to a respective bearing plate 24, the bearing plates 24 are engaged to one another in sequence as described above and mounted to the output shaft 20 as shown in FIGS. 3 and 4. This sequence of assembling the bearing plates 24 and rotary rings 21 is repeated until a predetermined number of bearing plates 24 are mounted to the output shaft 20. Referring to FIG. 5, this assembly of bearing plates 24 and rotary rings 21 provides a wave form or sinusoidal configuration when assembled and mounted on the output shaft 20. In operation, the actuation unit 16 has a spiral wave form action illustrated by arrow A in FIG. 5 due to the respective movement of the bearing plates 24 and the output shaft 20 relative to the rotary rings 21.

Figure 8:
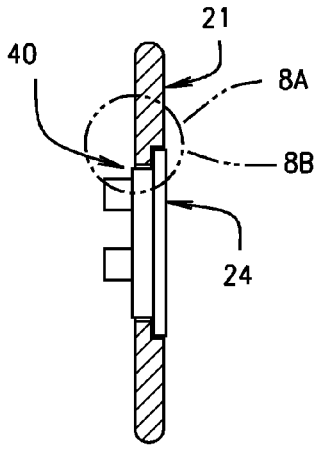
FIG. 8 is a partial cross sectional view illustrating the engagement of the bearing plate with the rotary ring.
Figure 8A:
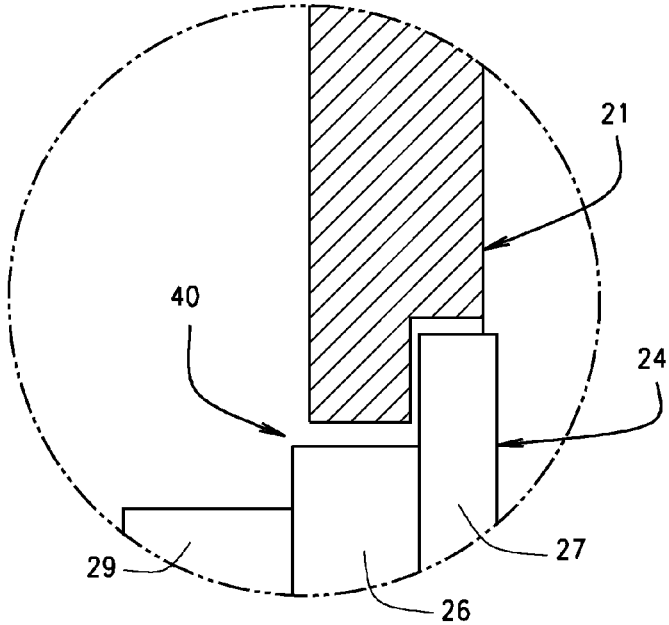
FIG. 8A is an enlarged view of FIG. 8 illustrating the gap defined between the rotary ring and the bearing plate.

When engaging the bearing plate 24 to the rotary ring 21 the circumference surface 26 of each bearing plate 24 is engaged with a respective center hole 22 of a rotary ring 21 such that the step hole 36 of each rotary ring 21 provides sufficient clearance to the rim 27 of the bearing plate 24 in order to define a gap 40 (FIG. 8A). The curved distal portion 60 of the output shaft 20 is inserted through the eccentric through-hole 25 in order to mount each bearing plate 24 along the length of the output shaft 20.

Referring back to FIG. 5, after the last bearing plate 24 is mounted to the output shaft 20, at that particular bearing plate 24 the output shaft 20 may be punched or otherwise deformed with a protrusion 38. The protrusion 38 formed on the output shaft 20 prevents axial movement of the entire assembly of bearing plates 24 and rotary rings 21 in the axial direction along the output shaft 20.

Figure 7A:
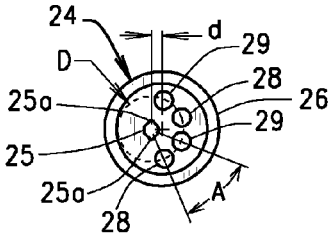
FIG. 7A is a front view of the bearing plate.
Figure 7B:
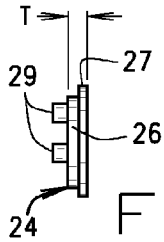
FIG. 7B is a side view of the bearing plate.
Figure 7C:
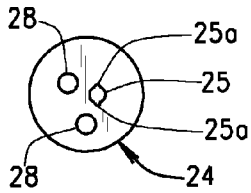
FIG. 7C is a rear view of the bearing plate.

Referring to FIGS. 7A-7C, the center of the eccentric through-hole 25 of the bearing plate 24 may be offset at a distance "d" from the center of the bearing plate 24. As shown, the holes 28 and pegs 29 may be circumferentially arranged at a diameter "D" about the center of eccentric through-hole 25 which is defined off-center relative to the bearing plate 24. An angle "A" may be defined between the center of the hole 28 and the center of an adjacent peg 29 about the center of the eccentric through-hole 25. In one embodiment, distance "d" may be 1.5 mm, diameter "D" may be 8.5 mm, and angle "A" may be 45 degrees. In addition, the rotary ring 21 may have a thickness "t", such as 2.2 mm, that is less than a thickness "T" of the bearing plate 24, such as 2.5 mm. However, the bearing plate 24 and rotary ring 21 may have other values for "d", "D", "A", "t" and "T".

Figure 8B:
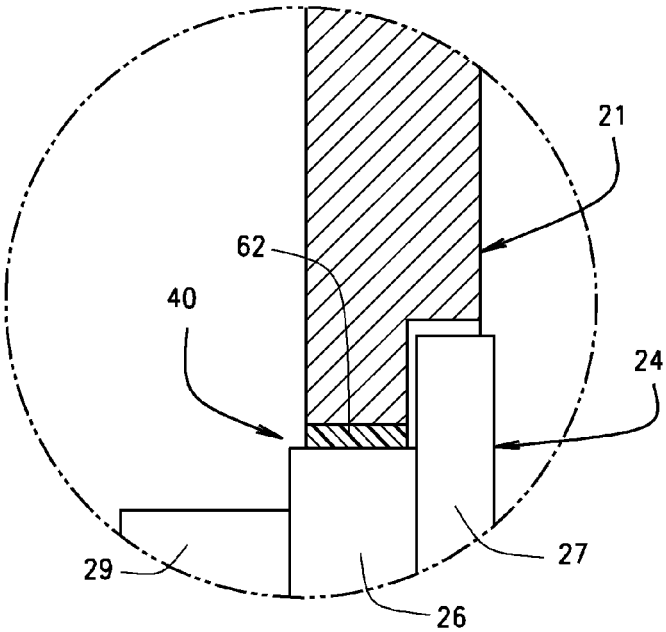
FIG. 8B is an enlarged view of FIG. 8 illustrating the anti-friction material disposed in the gap defined between the rotary ring and the bearing plate.

As shown in FIGS. 8, 8A and 8B, when the bearing plate 24 is engaged to the rotary ring 21*a* gap 40 is defined between the bearing plate 24 and the rotary ring 21 such that the rotary ring 21 can be freely rotated relative to the bearing plate 24. In one embodiment, an anti-friction material 62 may be disposed within the gap 40 to provide a means for preventing frictional contact between the rotary ring 21 and bearing plate 24. The anti-friction material 62 may be either a liquid, such as a lubricant, or a solid, such as a ring made of a material having a low friction coefficient.

Referring back to FIG. 1, when the output shaft 20 is rotated by the driving unit 18 the actuation unit 16 comprising the assembly of bearing plates 24 and rotary rings 21 rotates. When there is a restriction, for example by the outermost sleeve 15, being imposed upon the rotary rings 21 the rotary rings 21 will not follow the bearing plates 24 action of rotation, but will only have a slipping action relative to the bearing plates 24 and output shaft 20. The rotation of the bearing plates 24 in combination with the slipping action of the rotary rings 21 produces a spiral wave form action in a longitudinal direction by the actuation unit 16 that is imparted to the outermost sleeve 15. In addition, the segments 23 defined around the circumference of each rotary ring 21 promote this slipping action and inhibit each of the rotary rings 21 from following the rotating action of the bearing plates 24 such that the spiral wave form action is imparted to the outermost sleeve 15 by the actuation unit 16.

In one embodiment, the actuation unit 16 generates the spiral wave action in a longitudinal direction with the assembled bearing plates 24 and rotary rings 21 having a small cross-sectional shape. In another embodiment, the actuation unit 16 may have a plurality of cross-sectional shapes that provide massage action in directions perpendicular to the longitudinal axis of the massage device 10.

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

What is claimed is:

1. A massage device comprising:

a driving unit operatively engaged to a rotatable output shaft having a distal end portion, a handle having a power source in operative association with said driving unit, said handle having a control panel for controlling the operation of said driving unit; and an actuation unit operatively engaged to the output shaft of the driving unit, the actuation unit including an arrangement of bearing plates engaged to one another and mounted along the output shaft with each bearing plate being engaged to a rotary ring, wherein each rotary ring defines a center hole and a plurality of segments circumferentially defined about the center of the rotary ring, wherein each of the bearing plates defining a plurality of holes and pegs circumferentially spaced about an eccentric through-hole, wherein each rotary ring is adapted to be engaged within the center hole of one of the bearing plates such that the arrangement of bearing plates will rotate upon rotation of the output shaft while each rotary ring will have a slipping action relative to the output shaft in order to produce a spiral wave form action by the actuation unit.

2. The massage device of claim 1, wherein the bearing plates are engaged to one another by engaging the plurality of pegs of one of the bearing plates to the plurality of holes of another one of the bearing plates.

3. The massage device of claim 1, wherein the plurality of segments inhibits a rotating action by the rotary rings relative to the output shaft.

4. The massage device of claim 1 further including a hollow resilient outermost sleeve adapted to encase the actuation unit such that the spiral wave form action generated by the actuation unit is imparted to the outermost sleeve.

5. The massage device of claim 4, wherein operation of said driving unit causes the outermost sleeve to move in the spiral wave form action as the bearing plates are made to rotate and the rotary rings are prevented from having a rotating action relative to the output shaft.

6. The massage device of claim 1, wherein mounting the bearing plates to the output shaft requires the output shaft to be inserted through the eccentric through-hole of each of the bearing plates.

7. The massage device of claim 1, wherein the eccentric through-hole defines a pair of slots and the output shaft defines a pair of opposing protrusions, wherein the opposing protrusions are adapted to engage the opposing slots when mounting one of the bearing plates to the output shaft.

8. The massage device of claim 1, wherein the arrangement of bearing plates mounted to the output shaft has a sinusoidal configuration.

9. The massage device of claim 1, wherein at least one protrusion is engaged to one of the bearing plates mounted to the output shaft.

10. The massage device of claim 1, wherein said control panel having one or more actuators for controlling the operation of the massage device.

11. The massage device of claim 10, wherein one of the one or more actuators controls the spiral wave form action of the massage actuator.

12. The massage device of claim 1, the spiral wave form action is generated in a longitudinal direction relative to the output shaft.

13. The massage device of claim 1, wherein a gap is defined when the rotary ring is engaged to the bearing plate.

14. The massage device of claim 13, wherein an anti-friction material is disposed in the gap to prevent frictional contact between the bearing plate and the rotary ring.

15. A massage device for providing a spiral wave form action comprising:

a driving unit operatively engaged to a rotatable output shaft having a distal end portion, a handle having a power source in operative association with the driving unit, the handle having a control panel for controlling the operation of said driving unit; and an actuation unit operatively engaged to the output shaft of the driving unit having an arrangement of bearing plates mounted to the output shaft with each of the bearing plates being engaged to a rotary ring, an anti-friction material being interposed between the bearing plates and a respective rotary ring, wherein actuation of the output shaft causes the plurality of bearing plates to have a rotating action and the respective rotary ring to have a slipping action relative to the output shaft in a manner that causes the actuation unit to have a spiral wave form action.

16. The massage device of claim 15 further including a hollow resilient outermost sleeve adapted to engage the actuation unit such that a spiral wave form action is imparted by the actuation unit during operation of the driving unit.

17. The massage device of claim 15, wherein the anti-friction material is a lubricant or a material having a low friction coefficient.

18. The massage device of claim 15, wherein the power source is one or more batteries.

19. The massage device of claim 15, wherein said control panel having a plurality of actuators for controlling the various operations of the massage device.

20. A massage actuator comprising:

a driving unit operatively associated with a rotatable output shaft; and an actuation unit operatively engaged to the driving unit, the actuation unit including a plurality of bearing plates engaged to one another and mounted on the output shaft with each bearing plate defining an eccentric through-hole for mounting the output shaft, a plurality of rotary rings with each rotary ring being adapted to engage a respective one of the plurality of bearing plates, wherein rotation of the output shaft causes the plurality of bearing plates to have a rotating action and the plurality of rotary rings to have a slipping action which collectively produces a spiral wave form action in a longitudinal direction by the actuation unit.

21. The massage actuator of claim 20, wherein the output shaft defines a pair of opposing protrusions and the eccentric through-hole defines a pair of slots adapted to engage the pair of opposing protrusions.

22. The massage actuator of claim 20, wherein the eccentric through-hole is defined off-center relative to the bearing plate.

* * * * *

UNITED STATES PATENT AND TRADEMARK OFFICE

CERTIFICATE OF CORRECTION

PATENT NO. : 7,988,650 B2
APPLICATION NO. : 12/024788
DATED : August 2, 2011
INVENTOR(S) : Simon Siu Man Nan It is certified that error appears in the above-identified patent and that said Letters Patent is hereby corrected as shown below:

Col. 2, line 57: “which follows” should read --which follows.--

Col. 5, line 2: “21a gap” should read --21, a gap--

Claim 12, first line, col. 7: “claim 1, the sprial” should read --claim 1, wherein the spiral--

Signed and Sealed this
Third Day of April, 2012

David J. Kappos

David J. Kappos
*Director of the United States Patent and Trademark Office*